United States Patent [19]

Saunders et al.

[11] Patent Number: 4,748,431

[45] Date of Patent: May 31, 1988

[54] ELECTRICAL SWITCHES

[75] Inventors: Arthur J. Saunders, Bucks; Raymond D. Rochester, Bedford, both of England

[73] Assignee: Harvey Hubbell, Ltd., United Kingdom

[21] Appl. No.: 72,393

[22] Filed: Jul. 13, 1987

[30] Foreign Application Priority Data

Apr. 10, 1987 [GB] United Kingdom ..... 8708637

[51] Int. Cl.[4] ..... H01H 85/00

[52] U.S. Cl. ..... 337/10; 337/7; 335/131

[58] Field of Search ..... 337/10, 11, 7, 8; 335/201, 131, 132

[56] References Cited

U.S. PATENT DOCUMENTS

| | | | |
|---|---|---|---|
| 3,293,392 | 12/1966 | Cataldo et al. | 337/7 |
| 3,325,615 | 6/1967 | Schneider et al. | 337/10 |
| 3,490,309 | 1/1970 | Gustavson | 74/520 |
| 4,001,661 | 1/1977 | Terabayashi | 318/267 X |
| 4,394,605 | 7/1983 | Terazawa | 318/291 X |
| 4,468,596 | 8/1984 | Kinzl et al. | 318/286 X |
| 4,476,416 | 10/1984 | Licata et al. | 318/286 X |

FOREIGN PATENT DOCUMENTS

| | | | |
|---|---|---|---|
| 2820330 | 11/1979 | Fed. Rep. of Germany | 318/283 |
| 3305770 | 8/1984 | Fed. Rep. of Germany | 318/283 |
| 59-59087 | 4/1984 | Japan | 318/283 |

*Primary Examiner*—H. Broome

*Attorney, Agent, or Firm*—Jerry M. Presson

[57] ABSTRACT

In an electric switch of the kind comprising a rectilinearly movable contact carrier (31), contacts (33) of which cooperate with fixed contacts (10A–17A,20A–25A) of a housing (19) defining spaces containing the fixed and moving contacts, which spaces are vented to atmosphere, the moving contact carrier (31) is provided with barriers or partitions (40) that cooperate with corresponding barriers or partitions (41,42) of the switch housing to subdivide the contact containing spaces in a labyrinthine manner. As the moving contact carrier (31) moves from the closed to open contact position, the respective barriers or partitions (40–42) of the contact carrier and the housing move relatively in a direction towards one another. This serves to minimize the risk of ionized gases passing between contact containing spaces of the housing (19) upon opening of the switch contacts.

10 Claims, 7 Drawing Sheets

ELECTRICAL SWITCHES

FIELD OF INVENTION

This invention concerns improvements in and relating to electrical switches, and more especially, but not exclusively, to electrical switches of the kind utilized for providing switching of the individual phases of a multi-phase AC mains supply.

BACKGROUND OF THE INVENTION

Electrical Switches of the so-called universal fuse-switch type are marketed by the assignee of the instant invention under the designations UFS 1 and UFS 2.

One problem involved in such switches which requires improvement is to ensure the isolation of bursts of ionized gas that are typically generated upon breakage of the circuits corresponding to the respective phases of the AC mains supply. Isolation must be effected in such a manner that arcing does not occur between the respective phases of the supply as a result of the presence of the ionized gases that may provide a path of reduced resistance through the air dielectric between adjacent terminals or switch contacts of the respective phases.

Another aspect of such switches that is susceptible of improvement involves the manual actuating mechanism. Switches of the kind referred to above are actuated by means of a rotary spindle and the actuating mechanism incorporates two degrees of lost motion, firstly between the moving contacts of the switch and an over-center spring mechanism for providing snap-actuation of the switch during opening and closing of the switch contacts and secondly, between the manual actuating spindle and the over center spring mechanism, in order to prevent the over center spring mechanism from being held manually against the action of the over center spring. In order that the position of the actuating spindle in the idle condition of the switch should accurately reflect the open or closed condition of the switch, it is desirable that the actuating spindle should be reliably spring loaded into a rest position that is constant with respect to its range of lost motion. In hitherto known switches of the type referred to, frictional forces on the operating spindle tend to allow the latter to occupy a rest position that is displaced from the intended position, so that the position of the manual actuating member does not always clearly correspond to the appropriate rest condition of the switch.

OBJECT OF THE INVENTION

It is accordingly an object of the present invention to overcome, or at least reduce, one or more disadvantages referred to hereinabove and thereby provide an improved fuse switch.

SUMMARY OF THE INVENTION

In accordance with one aspect of the invention there is provided an electric switch comprising a switch housing assembly having a plurality of pairs of fixed contacts; at least one moving contact carrier having a moving contact (or contacts) corresponding to each of said pairs of fixed contacts. The moving contacts carrier is arranged for rectilinear sliding movement within said housing along an axis to bring said moving contacts into or out of engagement with said fixed contacts. There is at least one fixed barrier or partition provided within said housing and extending towards said moving contact carrier generally transversely to said axis of movement and at least one barrier or partition is provided on said moving contact carrier which extends generally transversely to said axis of movement. The respective barriers or partitions provide at least one labyrinthine passage restricting the flow of ionized gases between spaces of said housing each containing cooperating ones of said fixed and moving contacts; the arrangement being such that as said moving contact carrier moves along said axis towards an open circuit condition of said contacts the respective barriers or partitions move towards one another to further restrict said labyrinthine passage. Additionally, the housing assembly is provided with gas vents opening from said spaces to the exterior of said switch housing.

In accordance with another aspect of the invention that is utilizable either alone or in combination with the first aspect of the invention referred to, there is provided an electric switch actuating mechanism, comprising a rectilinearly slidable actuating member for transmitting motion to moving contacts of the switch. A first rotary member is coupled to said actuating member by means of a cam transmission whereby rotary movement of said first rotary member is accompanied by rectilinear movement of said actuating member. A second rotary member, mounted for rotation coaxially with said first rotary member, is coupled thereto by means of a first lost motion coupling and associated with an over center spring mechanism, whereby the second rotary member is spring loaded into each of two end positions of rotary movement corresponding to the respective end positions of said first rotary member and said actuating member. A third, manually actuatable, rotary member is mounted for rotation coaxially with said first and second rotary members and is coupled to said second rotary member by means of a second lost motion coupling; the third rotary member being formed as a hub having a cylindrical portion and a radial key projection. The second rotary member is formed in two parts arranged to meet in a plane perpendicular to its rotary axis and respectively having cavities for embracing said cylindrical portion and said radial key projection of said third rotary member. Thusly, the cylindrical portion forms the pivot for said second rotary member and the radial key portion is received within a recess allowing limited angular motion thereof and thereby forming said second lost motion coupling. Cavities in said two parts of said second rotary member are provided to receive and retain captive a compression spring for engaging said key portion and spring loading said second lost motion coupling into one end position.

Preferred features and attendant advantages of each of the aspects of the invention referred to will become apparent from the following description taken in conjunction with the accompanying drawings, it being understood that the specific description is to be taken by way of example only, and that the applicants claim protection in respect of any inventive concept underlying the disclosure that may be apparent to one skilled in the art having a full knowledge of the complete state of the art as existing at the date of this Application.

DRAWINGS

The invention is illustrated by way of example in the accompanying drawings in which;

FIG. 1 is an elevation of switch assembly according to one embodiment of the invention, FIG. 2 is a similar view taken in the direction of the arrow A of FIG. 1, FIG. 3 is a plan view of the assembly of FIGS. 1 and 2, FIG. 4 is a sectional view on the line IV—IV of FIG. 2, FIG. 5 is a sectional view on the line V—V of FIG. 4, FIG. 6 is a side view of a moving contact carrier of the switch assembly, FIG. 7 is a plan view corresponding to FIG. 6, FIG. 8 is a sectional view on the line VIII—VIII of FIG. 1, FIG. 9 is an enlarged fragmentary section on the line IX—IX of FIG. 8, FIG. 10 is an exploded perspective view corresponding to FIG. 9, FIG. 11 is a view of the switch actuating mechanism with an end cover removed, shown in the position in which the switch contacts are closed, FIG. 12 is a sectional elevation of the switch actuating mechanism on the line XII—XII of FIG. 11, and, FIG. 13 a view corresponding to a fragment of FIG. 11 with a component removed to show internal detail.

DETAILED DESCRIPTION OF THE INVENTION

Figure 1:
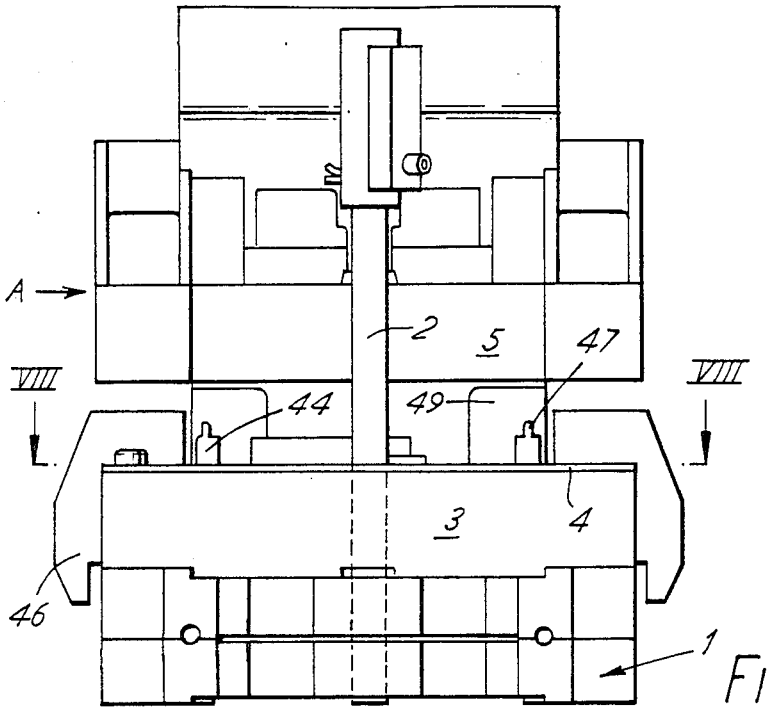

Referring to the accompanying drawings, a UFS switch assembly in accordance with one embodiment of the invention is of a so-called "sandwich" construction, and comprises a housing 1 forming a first layer and containing a switch actuating mechanism arranged for actuation by means of a manually rotatable spindle 2, a terminal mounting and contact mechanism 3 forming a second layer of the assembly which is superimposed upon the housing 1, a cover plate 4 for the housing of the assembly 3, and a fuse carrier 5 that is assembled over the cover plate 4 and forms the upper layer of the switch, although part of the carrier 5 also projects into and cooperates with the contact mechanism 3, as will be apparent from the following description.

Figure 4:
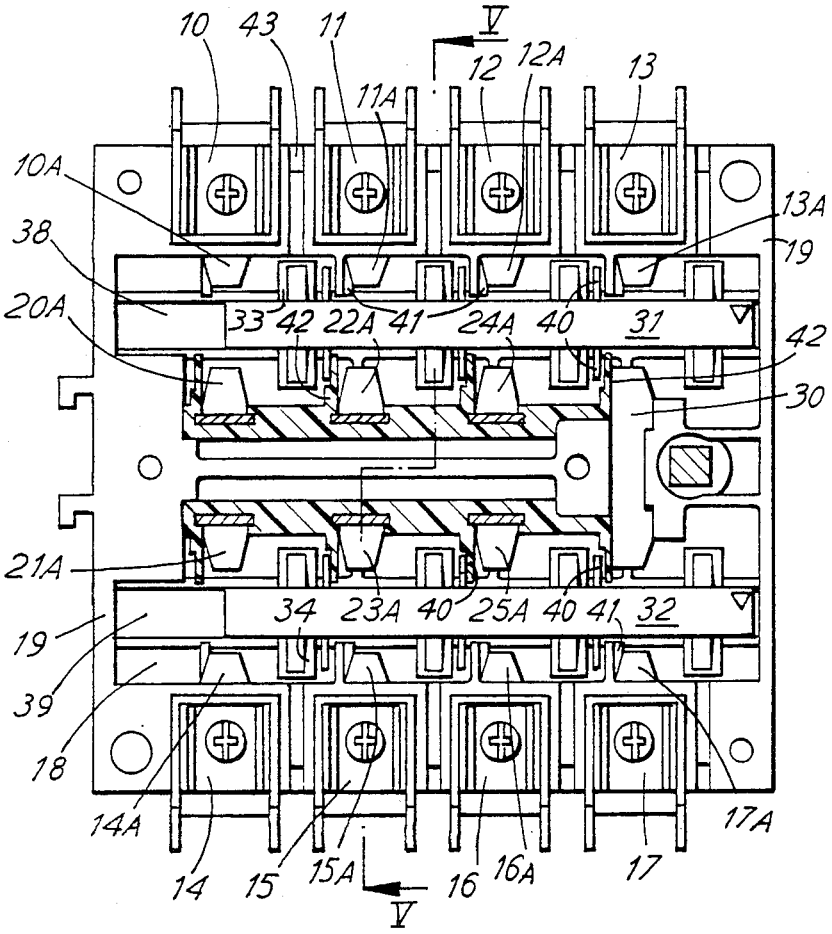
Figure 5:
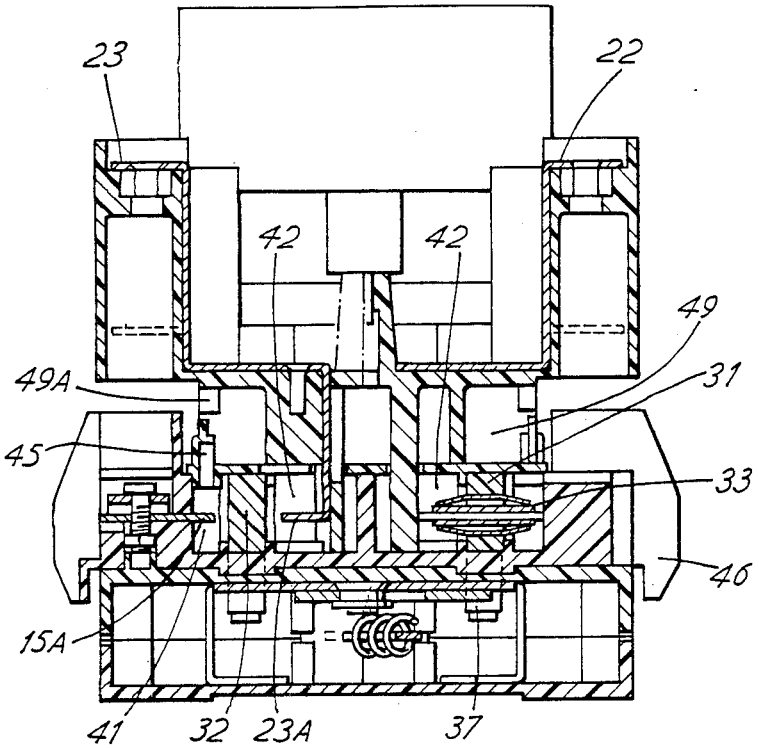

As can be seen more clearly from FIGS. 4 and 5, the terminal mounting and contact mechanism 3 comprises two arrays of four terminals 10, 11, 12 and 13, 14, 15, 16 and 17 respectively. Each terminal is electrically connected with a corresponding blade contact 10A to 17A, these contacts being located in a common plane within a recess 18 of a contact housing 19.

Figure 3:
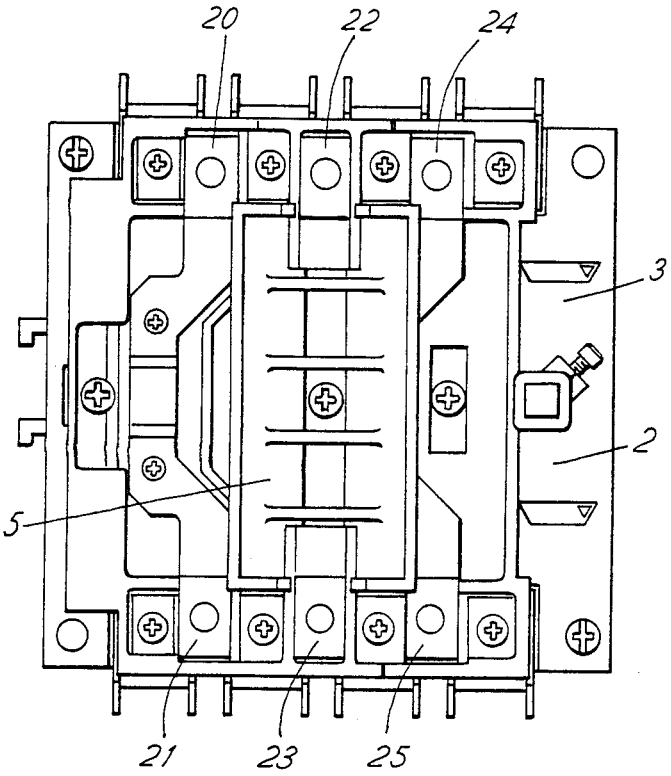

Referring to FIGS. 3 to 5, the fuse holder assembly 5 comprises opposed pairs of terminal contacts 20, 21; 22, 23; and 24, 25; each pair of terminal contacts being arranged to be bridged by a corresponding fuse so that the three fuses can provide appropriate protection for the three phases of a three-phase AC Mains supply. The terminal contacts 20 to 25 are each coupled to a corresponding stationary blade contact 20A to 25A, the latter have a similar configuration to the contacts 10A to 17A. All of the contacts 20A to 25A are located in the same plane, being arranged in such a manner that when the fuse holder assembly 5 is mounted on the contact mechanism 3, the switch contacts of the fuse holder become located in the same plane as, and directly in opposition to the corresponding contacts 10A, 11A, 12A and 14A, 15A, 16A, of the switch terminal assembly. The contacts 13A and 17A are similarly associated with a neutral link 30, which is arranged to make the circuit between neutral terminals 13 and 17 that do not require to be fused.

Figure 6:
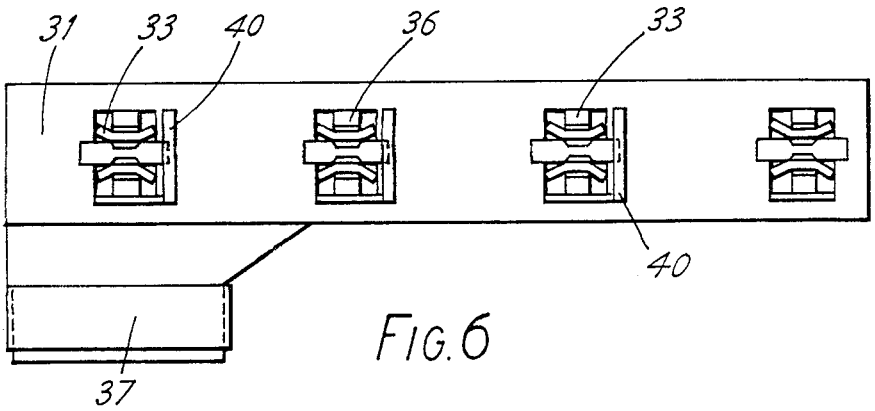
Figure 7:
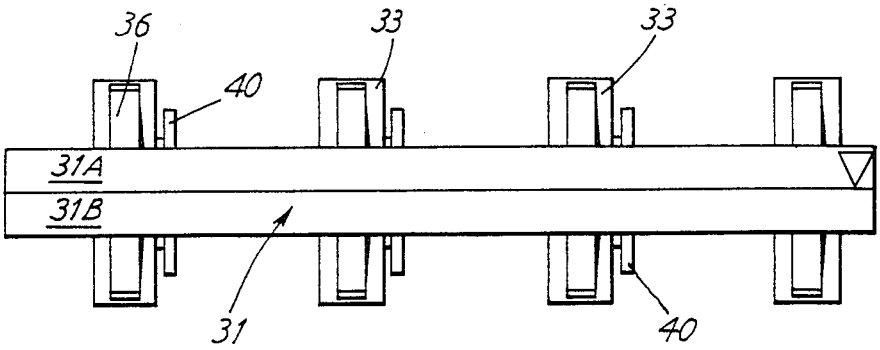
Figure 8:
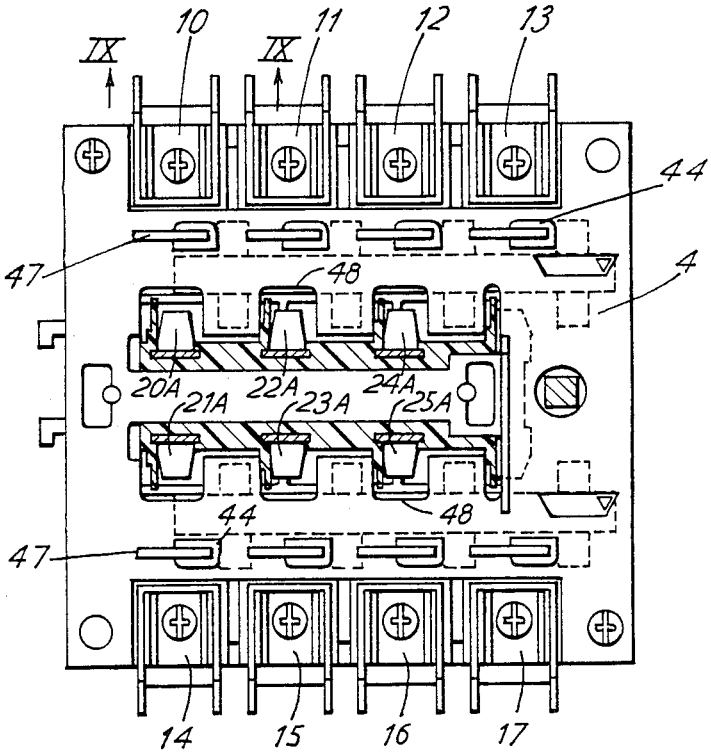

A switched connection between each opposed pair of blade contacts is arranged to be completed by moving contacts located on a corresponding one of two moving contact carriers 31 and 32, each of which carries a series of pairs of spring loaded contacts 33 and 34 respectively. The two moving contact carriers are identical, and the assembly 31 is illustrated in greater detail in FIGS. 6 and 7. The assembly comprises two opposed moldings 31A, 31B of synthetic plastics material, which are assembled together in order to retain captive between them the opposed pairs of contacts 33. The latter are spring urged towards one another by means of blade springs 36 so that they occupy rest positions in which they are spaced apart by a minimum distance smaller than the thickness of the corresponding blade contacts 10A to 17A and 20A to 25A, and have oblique flanks 33A by means of which they are spread apart to receive the blade contacts upon actuation of the switch. As can be seen from FIG. 6, each moving contact carrier 31 has a downward extension 37 which is arranged to pass through a corresponding aperture 38 or 39 of the housing 19 in order to enable displacement of the contact carriers by the switch actuating mechanism in a manner to be described below.

Each of the two portions 31A and 31B of the contact carrier 31 are provided with upstanding barriers or partitions 40 located adjacent those pairs of contacts 33 that are arranged to cooperate with the blade contacts to be connected to the three phases of the AC Mains supply. The purpose of the barriers 40 will be explained in more detail below.

Referring again to FIGS. 4 and 5, it will be seen that adjacent each of the six contacts 11A, 12A, 13A and 15A, 16A, the housing 19 is provided with a barrier or partition 41 extending in a plane perpendicular with respect to the plane of FIG. 4, and projecting towards the corresponding moving contact carrier 31 or 32. When the moving contact carriers 31 and 32 are in the opening circuit condition as illustrated in FIG. 4, the two sets of barriers or partitions 40 and 41 lie adjacent one another, and thus serve to form, together with the body 31 or 32 of the moving contact carrier, confined spaces enclosing each switch contact 10A, 11A, 12A or 14A, 15A, 16A and the associated pair of moving contacts 33 or 34. The fuse carrier 5 is likewise provided with a similar barrier or partition 42 adjacent each blade contact, so that the blade contacts and associated moving contacts are likewise located within confined spaces defined between the barriers or partitions 40 and 42, when the switch is in the open circuit condition.

Figure 2:
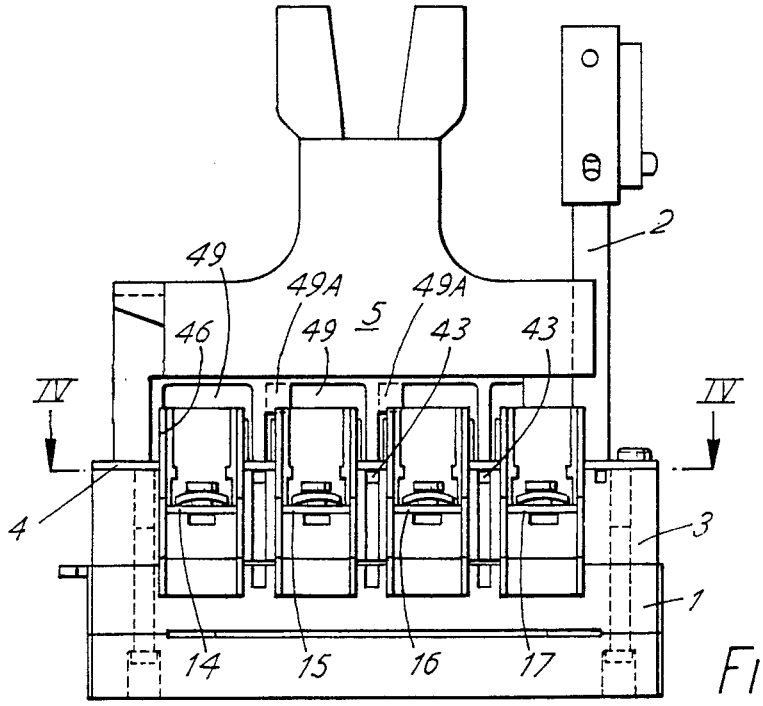

Each of the confined spaces referred to above housing the contacts 10A, 11A, 12A and 14A, 15A, 16A, are vented to atmosphere on the one hand by means of a corresponding recessed slot 43 in the surface of housing 19 between an adjacent pair of switch terminals, and on the other hand by a vent 44 formed in the cover plate 4. As can be seen more clearly from FIGS. 9 and 10, each vent 44 is in the form of a cowling defining a passage 45 directed away from an adjacent shroud 46 surrounding a corresponding switch terminal, each cowling 44 being integral with a partition 47 located in spaced relation with the shroud 46. The confined spaces associated with the switch contacts of the fuse carrier 5 are vented to atmosphere through recesses 48 in the cover plate 4. The passages 45 and recesses 48 communicate with corresponding cavities 49 in the underside of the fuse carrier assembly. The positions of the cavities 49 with respect to the vents 44, shrouds 46, partitions 47, and recesses 48 can be seen from FIGS. 1, 2 and 5. It will be noted that the vents 44 are offset with respect to the partitions 47, which serve to block the lower parts of the opening to cavities 49, and that each of the two middle cavities 49 has in the upper corner of each opening of the side opposite the vent 44, a web 49A (see FIGS. 2 and 5) the internal surface of which is inclined in a plane at 45° to the plane of the adjacent partition 47 for a purpose to be described below.

The operation of the switch described above is as follows. The two moving contact carriers 31 and 32 are coupled, by means of their extensions 37 to a common actuating member which, upon manual turning of the spindle 2 provides for snap-actuation of the moving contact carriers 31 and 32 such that they are both simultaneously moved longitudinally within the casing 19, e.g. in the direction of the arrow X of FIG. 9, to a left-hand end position in which the blade contacts 10A to 17A and the corresponding contacts 20A to 25A of the fuse carrier assembly are embraced between the moving contacts 33 and 34. Thus a circuit is completed between each two opposed blade contacts of the mechanism 3 by means of corresponding contacts 33 or 34 of each of the two moving contact carriers 31 and 32 to complete a series circuit between opposed pairs of switch terminals that includes a fuse mounted between terminals of the fuse carrier 5. A similar series circuit is completed to include the neutral link 30.

When the switch is actuated in the reverse direction, i.e. to move the contact carriers 31 and 32 in the reverse direction to the position illustrated in FIG. 4, the arcing that will occur between the fixed and moving contacts of the switch during breaking of the current circuits causes the emission of bursts of ionized gas that must be isolated in order to avoid danger of a current path being established through the ionized gas between adjacent switch contacts coupled to different phases of the AC mains supply. As a result of the above described arrangement of the barriers or partitions 40, 41 and 42, the spaces defined between the moving contact carrier 31 and the housing 19 or fuse carrier 5, and that contain each cooperating pair of switch contacts, are divided in a labyrinthine manner by the barriers 40 of the contact carrier 31. As the contact carrier 31 moves towards the open circuit condition, the barriers 40 approach the barriers 41 and 42 to further confine the relevant spaces at the boundary between the contact carrier 31 and the barriers 41 and 42. This ensures that the burst of gas generated in the region of each of the associated blade and moving contacts within the housing 19 is restricted to the corresponding confined space that is defined by the adjacent barriers 40 and 41 or 42. This gas is then vented to atmosphere by the vents 44 and recesses 48 and by the recessed slots 43, in combination with the cavities 49, barriers 47 and shrouds 46. Gas in the region of the fixed contacts of the fuse carrier 5 escapes from the recesses 48 and passes into the back of the cavities 49 from where it is deflected outwardly and upwardly over the inclined upper edges of the barriers 47 and the shrouds 46 of those terminals corresponding to the phase from which the ionized gas generated. The inclined webs 49A also serve to direct emitted gases away from terminals of the adjacent phase. Gas in the region of the fixed contacts of the mechanism 3 passes from the vent passages 45 and into the cavities 49 to escape in similar manner. The offset positions of the vents 44 also assists isolation of the emitted gases from the terminals of an adjacent phase. As will be seen more clearly from FIGS. 9 and 10, the underside of the cover plate 4 is formed with raised portions 44A forming extensions of the cowlings 4 and serving to conduct gases both to the passages 45 and to the recessed slots 43. The upper edges of barriers 40 are thus arranged to terminate slightly below the upper edges of the barriers 41 and 42, to leave room for the portions 44A. The latter, together with downturned lips 4A on the cover plate 4 form guides for the upper longitudinal edges of the moving contact carrier 31.

Figure 11:
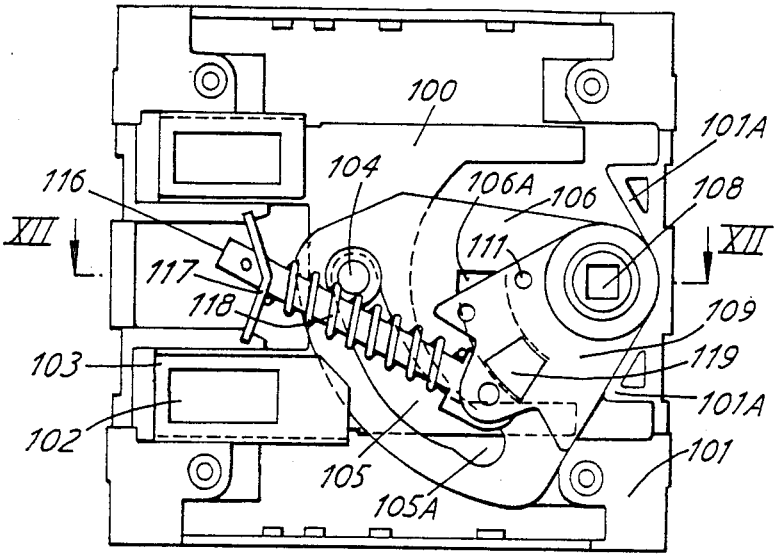
Figure 12:
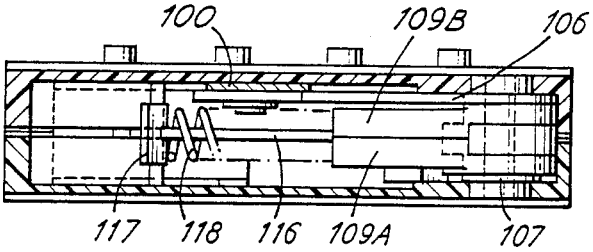
Figure 13:
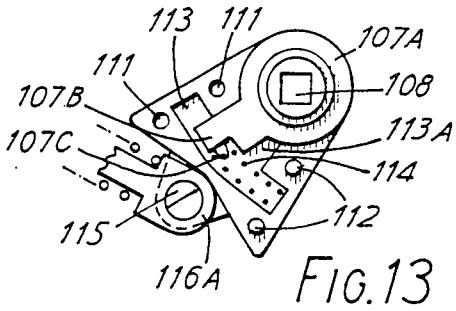

Referring now to FIGS. 11 to 13, the actuating mechanism of the switch will be described in more detail. FIG. 11 is a bottom view of the switch actuating mechanism 1 with the lower cover removed. The mechanism comprises a rectilinearly slidable member 100 that is guided within a corresponding recess in the housing 101 of the mechanism and is provided with apertures 102 for engagement by the extensions 37 of the moving contact carriers of the switch. The housing 101 is provided with corresponding apertures that register with the apertures 38 and 39 of the contact mechanism 3. In order to provide for mounting of the actuating mechanism 1 with respect to the mechanism 3 in either of two optional positions, both opposed faces of the housing 101 are provided with such apertures, and the slide member 100 is provided with U-shaped extensions 103 configured so that apertures 102 are available on both sides of the housing 101, either in the base portion of the slide 100, or in the two extensions 103. The slide member 100 carries an upstanding pin 104 that engages in a cam slot 105 of a rotary plate 106, that is freely rotatable coaxially with the actuating spindle 2 upon a hub member 107 (FIGS. 12 and 13) that is keyed to the spindle 2 via a keyway 108.

Also freely rotatably mounted about the hub 107 is a switch actuating lever 109 that is formed of two identical synthetic plastics moldings 109A and 109B that mate with one another to enclose the hub member 107 in a manner more clearly apparent from FIGS. 12 and 13.

Each of the two half-moldings of the lever 109 comprises a main body portion 110 having the general shape of an arrow head, and the thickness of which corresponds to half the thickness of the complete lever 109. Upstanding pins 111 on each molding 109A and 109B engage corresponding apertures 112 on the other component, in order to retain them in registry. Both components contain identical and symmetrical anchor-shaped recesses 113 which register to enclose between them a part of the cylindrical periphery 107A of hub 107 a radial projection 107B thereof, and a helical compression spring 114 that engages between one end of each of the two recesses and a tangentially extending pin 107C of the hub 107. It will be noted that an intermediate portion 113A of the recess 113 is sufficiently wider than the radial extension 107B as to allow lost rotary motion of the hub 107 with reference to the lever 109, although the helical compression 114 tends to maintain the two parts in one relative position at the end of the range of lost motion, when in the idle condition.

Each of the two parts 109A and 109B also comprises an upstanding semicylindrical peg 115, which together forms a mounting pivot for a lever 116. The free end of each semicylindrical peg 115 of one component is received within a corresponding semicylindrical recess of the other.

The lever 116 is formed of sheet metal, and the free end thereof is received within a slot of a bridge piece 117 engaged with corresponding mounting slots of the housing 101. A compression spring 118 engages around the lever 116 and is maintained in state of partial compression between the bridge piece 117 and a widened head portion 116*a* of the lever 116. The lever 116 and compression spring 118 thus form an over-center spring mechanism that will force the lever 109 into each two end positions wherein the side flanks thereof engage with corresponding abutments 101A of the housing 101.

It will further be noted that each of the two components 109A and 109B includes an external partially arcuate projection 119 an appropriate one of which engages within an arcuate slot 106A of the rotary plate 106.

The operation of the actuating mechanism will now be described assuming that the components are moved from the starting position as shown in FIG. 11, which corresponds to the position in which the switch contacts are closed.

Figure 9:
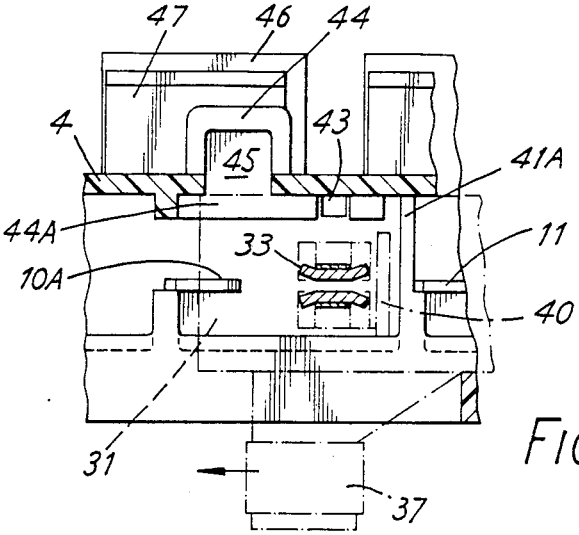
Figure 10:
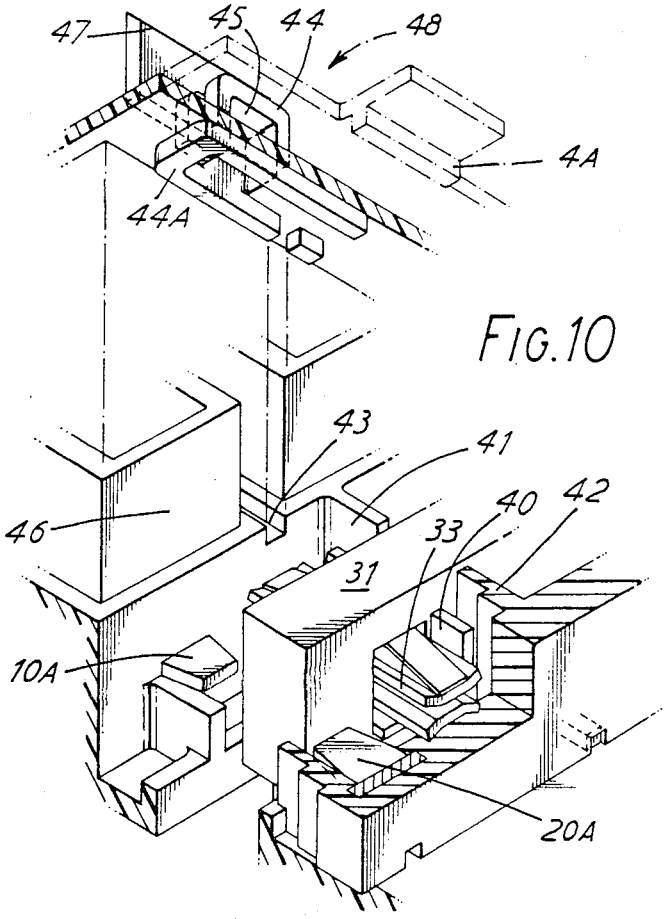

By means of the operating spindle 2 engaging in the key-way 108 of the hub member 107, the latter is turned in a clockwise direction, as viewed in FIGS. 9 and 11. The radial projection 107B of the hub 107 engages the upper end of the recess portion 113A and thus the lever 109 is also turned clockwise and the spring 118 is compressed upon the lever 116 until it reaches the over center position. The cam plate 106 initially remains stationary, since the projection 119 of lever 109 can move within the arcuate slot 106A. Shortly before the spring 118 reaches the over center position the arcuate projection 119 reaches the end of the slot 106A, and thus the plate 106 is turned slightly clockwise under manual action of the spindle 2 before the compression spring 118 rapidly snaps the lever 109 into the other end position wherein it is arrested by the abutment 101A. Thus the switch contacts are initially moved manually in order to ensure breakage of any welded points between the contacts. In view of the lost motion coupling between the hub 107 and the lever 109 it is impossible for the lever 109 to be arrested manually as it passes through the over center position and the lever 109 will thus overtake the hub 107 with consequent compression of the spring 114. Thus snap actuation of the lever 109 to break the switch circuit is ensured. As the lever 109 passes through its over center position, the rotary cam plate 106 is thus snapped into its opposite end position. By means of the engagement of the cam slot 105 with the pin 104 of member 100, the latter is therefore shifted rectilinearly from one end- position to the other and carries with it the two contact carriers 31 and 32.

Operation of the switch in the reverse direction is effected in a substantially identical manner, except that the spindle 2 is turned in the anticlockwise direction, and that since the projection 107B commences in engagement with the upper edge of the recess portion 113A, it is necessary for the spring 114 to be compressed during initial actuation of the spindle 2, until the projection 107B engages the lower end of the recess 113 to turn the lever 109.

What is claimed is:

1. An electric switch comprising:

a switch housing assembly having a plurality of pairs of fixed contacts;

at least one moving contact carrier having at least one moving contact corresponding to each of said pairs of fixed contacts, said moving contact carrier being arranged for rectilinear sliding movement within said housing along an axis, to bring said moving contacts into or out of engagement with said fixed contacts;

at least one fixed barrier provided within said housing and extending towards said moving contact carrier generally transversely to said axis of movement;

at least a second barrier provided on said moving contact carrier and extending generally transversely to said axis of movement;

the barriers serving to define at least one labyrinthine passage restricting the flow of gas between spaces of said housing each containing cooperating ones of said fixed and moving contacts;

the arrangement being such that as said moving contact carrier moves along said axis towards an open circuit condition of said contacts the respective barriers move towards one another to further restrict said labyrinthine passage;

and, the said housing assembly being provided with gas vents opening from s id spaces to the exterior of said switch housing.

2. An electric switch as claimed in claim 1, wherein said contact carrier comprises an elongate member the major axis of which is parallel to the axis along which said contact carrier is arranged for rectilinear sliding movement; said housing assembly includes opposed walls lying in planes substantially parallel to one another and to the said axis of sliding movement between which walls the contact carrier is guided; said moving contact carrier has, projecting from at least one longitudinal side thereof extending between said opposed walls of said housing assembly, a plurality of said moving contacts spaced apart along the major axis thereof and one said barrier extending between each two adjacent moving contacts on the respective side of the contact carrier in a plane perpendicular to the said major axis and to the planes of said opposed walls; and said housing assembly has, disposed between the planes of said opposed walls, a plurality of fixed contacts arranged along at least one axis parallel to said major axis for cooperation with moving contacts on said at least one side of said moving contact carrier, and another said second barrier or partition extending between each two adjacent fixed contacts, in a plane perpendicular to the said major axis and to the planes of said opposed walls.

3. An electric switch as claimed in claim 2, wherein said contact carrier comprises said moving contacts and said one barrier on two opposite longitudinal sides thereof, and said housing is correspondingly provided with fixed contacts and barriers on both sides of said contact carrier, whereby of each of said pairs of fixed contacts one contact of the pair is located on each of said opposite sides of the contact carrier.

4. An electric switch as claimed in claim 3, comprising two of said contact carriers arranged laterally adjacent one another for common movement along mutually parallel axes, said axes being spaced apart in a direction parallel to the planes of said opposed walls of the housing

5. An electric switch as claimed in claim 4, wherein fixed contacts provided in said housing in the region between said two adjacent contact carriers, together with associated barriers, are located upon a fuse carrier mounted externally of one of said opposed walls of the housing and arranged to project into said housing through said one wall, said fuse carrier being arranged to provide a fused link between at least one set of two opposed fixed contacts of which each is associated with a moving contact of a different one of the moving contact carriers whereby at least one set of two of said pairs of fixed contacts is arranged to be coupled in series by way of moving contacts of the two moving contact carriers and the respective fused link.

6. An electric switch as claimed in claim 5, including an actuating mechanism mounted externally of the other one of said opposed walls of the housing, the said moving contact carriers having portions projecting through said other wall to engage said actuating mechanism.

7. An electric switch as claimed in claim 6, wherein those fixed contacts of the housing located on the remote sides of the two contact carriers are associated with terminals located externally of said one wall of the housing, said terminals being electrically isolated from one another by shrouds upstanding from said one wall; and said fuse carrier is arranged to define, between itself and the exterior of said one wall, cavities communicating with said vents and arranged to direct vented gases laterally outwards above said terminal shrouds in such a manner that in each case the gas which passes above a given terminal is derived from one or more spaces containing contacts of the series circuit associated with that terminal.

8. An electric switch as claimed in claim 7, wherein the said one wall of the housing further comprises upstanding partitions located in spaced relation to said terminal shrouds between the latter and said cavities, whereby said partitions serve to restrict the flow of gases from said cavities and to deflect such gases above the terminal shrouds.

9. An electric switch as claimed in claim 8, wherein the said upstanding partitions are formed integrally with cowlings providing communication between gas vents of the housing assembly and said cavities.

10. An electric switch actuating mechanism, comprising a rectilinearly slidable actuating member for transmitting motion to moving contacts of the switch; a first rotary member coupled to said actuating member by means of a cam transmission whereby rotary movement of said first rotary member is accompanied by rectilinear movement of said actuating member; a second rotary member mounted for rotation coaxially with said first rotary member, coupled thereto by means of a first lost motion coupling and associated with an over center spring mechanism whereby it is spring loaded into each of two end positions of rotary movement corresponding to respective end positions of said first rotary member and said actuating member; and a third, manually actuatable, rotary member mounted for rotation coaxially with said first and second rotary members and coupled to said second rotary member by means of a second lost motion coupling; the said third rotary member being formed as a hub having a cylindrical portion and a radial key projection, the said second member being formed in two parts arranged to meet in a plane perpendicular to its rotary axis and respectively having cavities for embracing said cylindrical portion and said radial key projection of said third member whereby said cylindrical portion forms the pivot for said second member and the radial key portion is received within a recess allowing limited angular motion thereof and thereby forming said second lost motion coupling; and said cavities in said two parts of said second member further being arranged to receive and retain captive a compression spring engaging said key portion and spring loading said second lost motion coupling into one end position.

* * * * *